US010959520B2

(12) United States Patent
Filipowicz

(10) Patent No.: US 10,959,520 B2
(45) Date of Patent: Mar. 30, 2021

(54) TILTABLE CABINET DRAWER

(71) Applicant: Poltex, Inc., Redmond, OR (US)

(72) Inventor: Mark Filipowicz, Scotts Valley, CA (US)

(73) Assignee: Poltex, Inc., Redmond, OR (US)

( * ) Notice: Subject to any disclaimer, the term of this patent is extended or adjusted under 35 U.S.C. 154(b) by 0 days.

(21) Appl. No.: 16/732,781

(22) Filed: Jan. 2, 2020

(65) Prior Publication Data

US 2020/0229599 A1 Jul. 23, 2020

Related U.S. Application Data

(60) Provisional application No. 62/793,407, filed on Jan. 17, 2019.

(51) Int. Cl.

| | |
|---|---|
| ***A47B 88/48*** | (2017.01) |
| ***A47B 88/487*** | (2017.01) |
| ***A47B 88/60*** | (2017.01) |
| ***A47B 88/40*** | (2017.01) |

(52) U.S. Cl.

CPC ..... *A47B 88/48* (2017.01); *A47B 88/402* (2017.01); *A47B 88/487* (2017.01); *A47B 88/60* (2017.01); *A47B 2210/0037* (2013.01)

(58) Field of Classification Search

CPC ..... A47B 88/48; A47B 88/487; A47B 88/60; A47B 88/402; A47B 88/403; A47B 2210/0037

USPC ..... 312/283, 286, 323, 334.12, 334.13

See application file for complete search history.

(56) References Cited

U.S. PATENT DOCUMENTS

| | | | | | |
|---|---|---|---|---|---|
| 328,015 | A | * | 10/1885 | Davis | |
| 369,243 | A | * | 8/1887 | Myers | |
| 686,777 | A | * | 11/1901 | Snook | |
| 2,055,170 | A | | 9/1936 | Brainard | |
| 2,272,819 | A | * | 2/1942 | Poetsch | 312/198 |
| 2,333,843 | A | * | 11/1943 | Cox | 312/334.12 |
| 2,566,186 | A | * | 8/1951 | Gillett | A47B 88/48 312/323 |
| 2,716,046 | A | * | 8/1955 | Minturn | A47B 88/57 312/286 |
| 2,839,349 | A | * | 6/1958 | Culver | A47G 21/14 312/323 |
| 3,912,341 | A | * | 10/1975 | Stein | A47B 88/493 384/18 |
| 3,975,071 | A | * | 8/1976 | Quinn | A47B 88/48 312/323 |
| 4,002,385 | A | * | 1/1977 | Hone | A47B 53/00 312/286 |
| 4,114,965 | A | | 9/1978 | Oye et al. | |
| 4,441,771 | A | * | 4/1984 | Roesler | A47B 88/60 312/322 |
| 5,064,256 | A | | 11/1991 | Shepherd | |

(Continued)

*Primary Examiner* — Daniel J Troy
*Assistant Examiner* — Timothy M Ayres
(74) *Attorney, Agent, or Firm* — Wendy W. Koba, Esq.

(57) ABSTRACT

A cabinet drawer is configured to fully extend from within a cabinet case, tilting downward and outward when fully extended to allow personnel to access items located at the rear of the drawer. Mating channels and slots in the drawer and associated support structure allow for full movement of the drawer, while preventing its disengagement from the cabinet. The inclusion of a downward tiltable drawer provides easy access to the contents of the drawer, regardless of its height.

8 Claims, 10 Drawing Sheets

(56) References Cited

U.S. PATENT DOCUMENTS

| | | | | | |
|---|---|---|---|---|---|
| 5,226,714 | A * | 7/1993 | Wright | A47B 88/48 | 312/323 |
| 5,344,228 | A * | 9/1994 | Kovarik | A47B 88/467 | 312/334.17 |
| 5,348,207 | A * | 9/1994 | Frank | B60R 9/042 | 224/309 |
| 7,090,316 | B2 * | 8/2006 | Model | A47B 88/48 | 312/323 |
| 7,140,703 | B1 * | 11/2006 | Holdgate, III | A47B 88/48 | 312/323 |
| 7,775,613 | B2 * | 8/2010 | Williams | A47B 46/005 | 312/321.5 |
| 8,926,031 | B2 * | 1/2015 | Belton | A47B 88/407 | 312/246 |
| 2007/0063626 | A1 * | 3/2007 | Scott | A47B 88/487 | 312/334.7 |
| 2013/0020225 | A1 * | 1/2013 | Zabinski | A47B 67/04 | 206/557 |

* cited by examiner

TILTABLE CABINET DRAWER

CROSS-REFERENCE TO RELATED APPLICATIONS

This application claims the benefit of U.S. Provisional Application No. 62/793,407, filed Jan. 17, 2019 and herein incorporated by reference.

TECHNICAL FIELD

The present invention relates to a drawer configuration particularly useful in supply cabinets and, more particularly, to a drawer that is configured to pull out and tilt downward such that items located in a rear portion of the drawer are easily accessible.

BACKGROUND OF THE INVENTION

Many conventional types of supply/storage cabinets have only a few shelves, since many people would otherwise have difficulty in accessing items stored at heights above about six feet or so. Indeed, even in conventional designs, the top shelf may be inaccessible to some users, or at least is located at a height where individuals tend to climb on chairs, etc., to reach items stored on the top shelf. Moreover, even shelves at reasonable heights may have an appreciable amount of wasted space in a rear area that is not readily accessible to most individuals. Another concern is that supplies located toward the rear of the shelves may be "lost" or forgotten, a real concern when a supply cabinet is used to store items (such as medicines or medical supplies) with an expiration date.

A specific implementation of a supply cabinet used in a hospital or medical office setting may not include a back wall. Instead, the cabinet is configured to open along both its "front" face and "rear" face (this type of cabinet referred to at times as a "nurse server", or a "pass-through" cabinet). The nurse server allows for staff to re-stock shelves from the one open side, as medical personnel remove items from the opposite open side. The need for both sides of a nurse server to be fully accessible, including the ability to reach items along the top-most shelf, is an important concern in the design of such cabinets.

SUMMARY OF THE INVENTION

The present invention addresses the concerns of the prior art, and relates to a cabinet drawer that is configured to fully extend from within a cabinet case, tilting downward and outward when fully extended to allow personnel to access items located at the rear of the drawer, eliminating the possibility of wasted space at the rear of the drawer. By virtue of utilizing a tiltable drawer, the cabinet may be configured to include additional drawers at a vertical height beyond the typical, since the downward/outward tilt of the drawer provides easy access.

In an exemplary embodiment of the present invention, a cabinet case is configured to allow for the tiltable drawers to be accessed from either side of the cabinet, such as required for the "nurse server" configuration mentioned above. In other embodiments, the drawers may only be accessible from a single side of the cabinet (i.e., a "single-sided" configuration instead of a two-way, pass-through configuration).

The inventive tiltable drawer may be retrofit into an existing cabinet, using an underlying shelf or ledge support to allow for full extension. Alternatively, the inventive tiltable drawer may be included in an originally manufactured cabinet, where the interior cabinet walls may be formed to include the requisite channels and stops used to control the movement and extension of the drawer (or, alternatively, a new construction cabinet may be configured to use the same support shelf/rail structure as available for retrofit applications).

An exemplary embodiment of the present invention takes the form of a tiltable drawer comprising a front panel, a rear panel, and a bottom surface disposed between and orthogonal to the first and rear panels. The drawer in particular further including a pair of opposing sidewalls extending from the front panel to the rear panel along open sides of the bottom surface, each sidewall including a longitudinal channel formed to extend along an outer surface thereof (with each longitudinal channel terminating at opposing stops in proximity of an edge location of each sidewall with a mating front and rear panel). The configuration further includes a support structure disposed adjacent to the pair opposing sidewalls, the support structure including a pair side plates, each side plate associated with a separate one of the pair of opposing sidewalls and including a longitudinal slot formed therethrough, each longitudinal slot terminating at opposing stops in proximity to an edge of an associated side plate. Additionally, the configuration includes a pair of circular rollers, each circular roller disposed to engage a sidewall longitudinal slot with its associated side plate slot, wherein upon movement of the tiltable drawer the pair of circular rollers allows for the pair of opposing sidewalls to fully extend and rotate downward, following the circular surface of the pair of circular rollers, wherein the inclusion of the opposing stops preventing the pair of opposing sidewalls from disengaging with the support structure upon full extension.

Other and further details and variations of the features of the present invention will become apparent during the course of the following discussion and by reference to the accompanying drawings.

BRIEF DESCRIPTION OF THE DRAWINGS

Referring now to the drawings, where like numerals represent like parts in several views.

DETAILED DESCRIPTION

Figure 1:
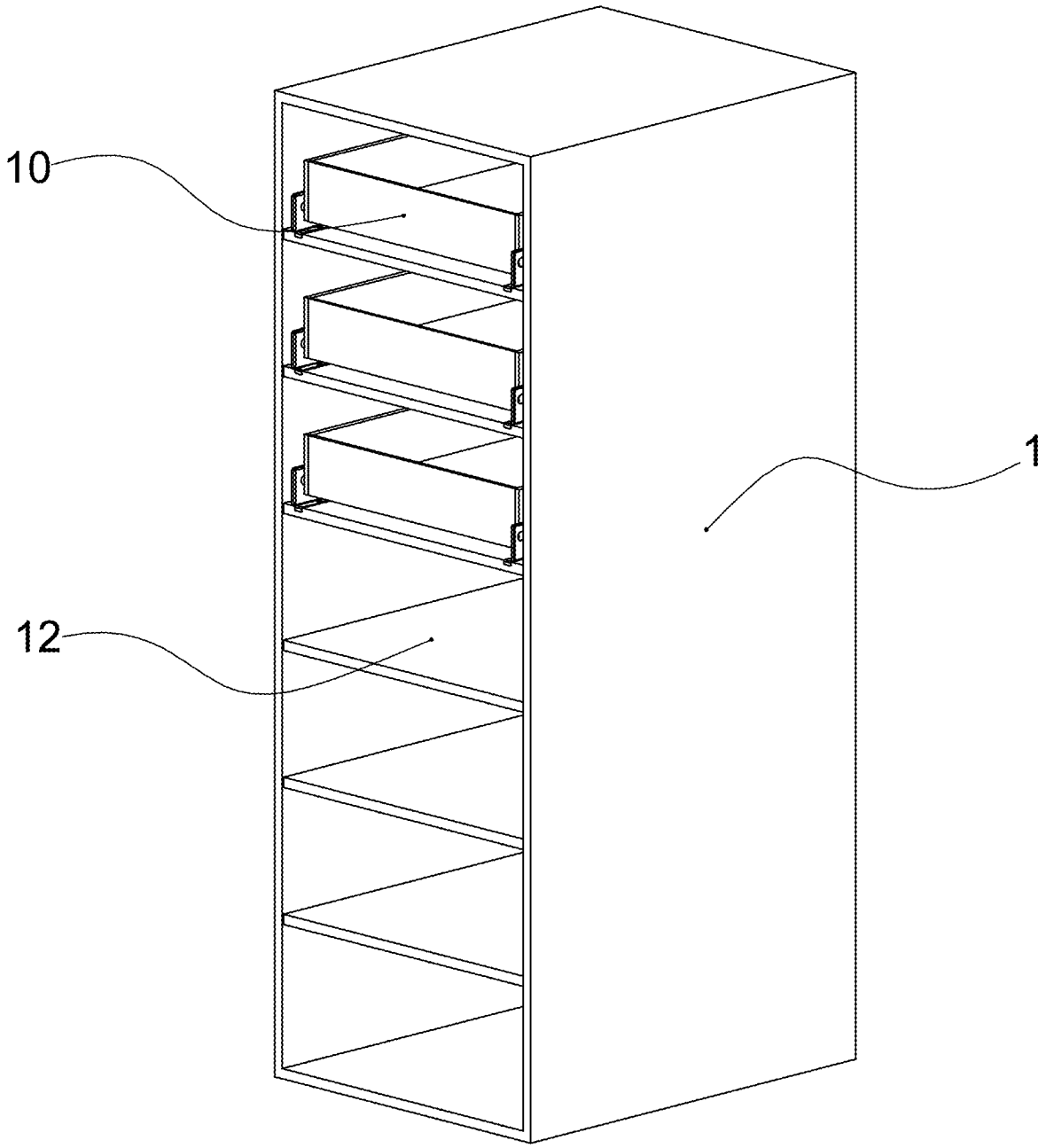
FIG. 1 is an isometric view of an exemplary cabinet including a tiltable drawer formed in accordance with the present invention.

FIG. 1 is an illustration of an exemplary cabinet 1 including a plurality of tiltable drawers 10 formed in accordance with the present invention. The particular drawing of FIG. 1 shows only the top three tiltable drawers 10 in place. A plurality of shelves 12 is also included in cabinet 1, where each shelf 12 is positioned to support a separate one of the tiltable drawers 10. The use of shelves 12 is only one exemplary type of support structure that may be used in conjunction with tiltable drawings 10 to ensure that drawers 10 do not disengage from cabinet 1 when fully extended. Other types of support structures will be discussed below in association with FIGS.

As mentioned above, a cabinet including the tiltable drawers of the present invention is well-suited for use in an above-the-counter application, where the use of a tiltable drawer that fully extends outward and downward to provide access to items stored at the back of the drawer is most beneficial. However, it is to be understood that the inventive tiltable drawer may be used in lower cabinet arrangements, rolling cabinets used in hospitals, tool cabinets, and the like.

Figure 2:
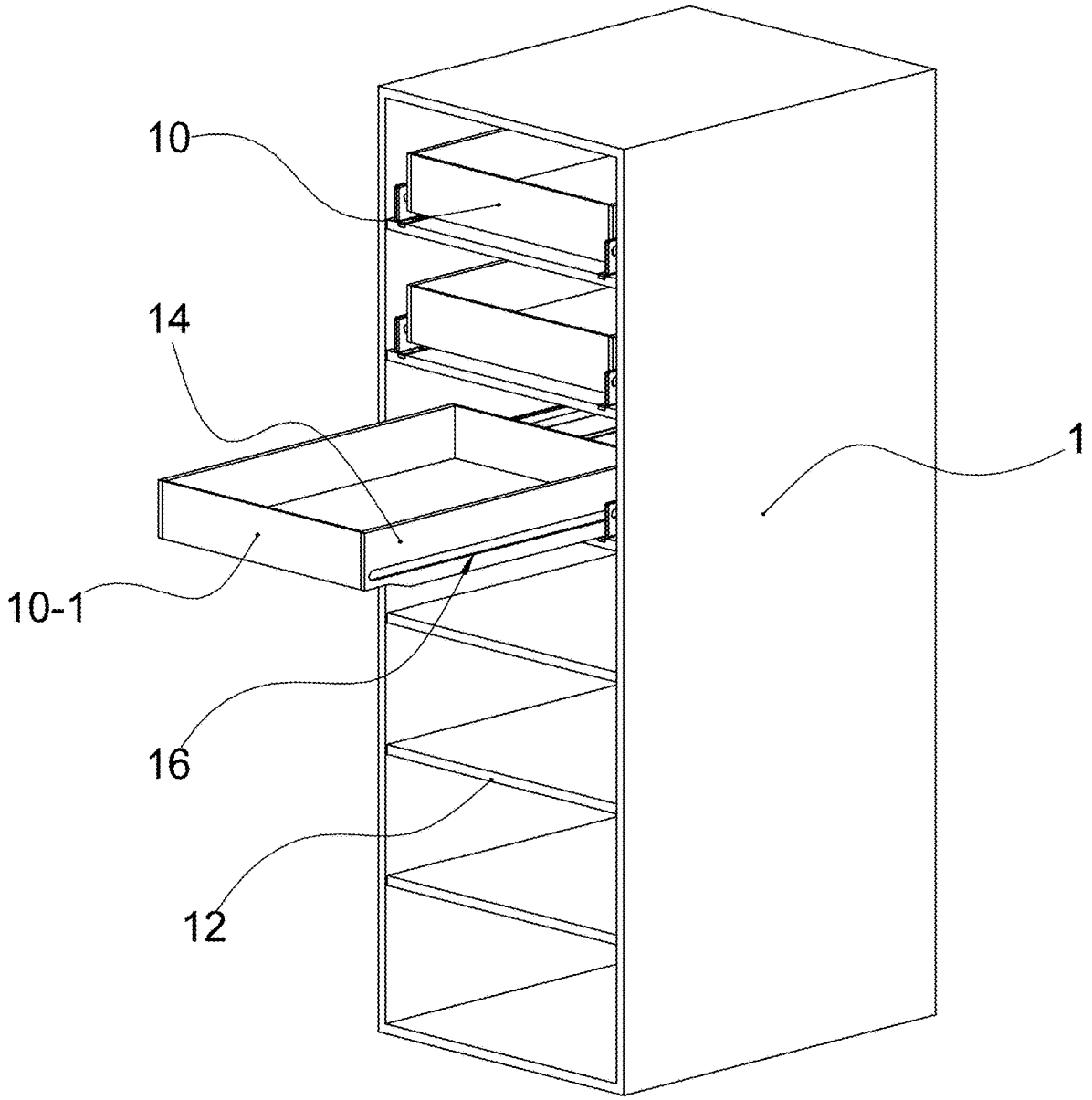
FIG. 2 is another isometric view of the cabinet of FIG. 1, in this case illustrating an exemplary tiltable drawer as partially extended.

FIG. 2 also illustrates cabinet 1, where in this drawing an exemplary tiltable drawer 10-1 has been pulled out (extended) a distance of approximately 75% of its length. As will be understood with respect to the following drawings, at this point in the movement of drawer 10-1, no tilt has yet been introduced to drawer 10. Drawer 10-1 itself is shown as comprising a pair of opposing sides 14, with a longitudinal channel 16 formed along the outer surface of each side 14. The purpose of longitudinal channels 16 will be explained in detail below.

Figure 3:
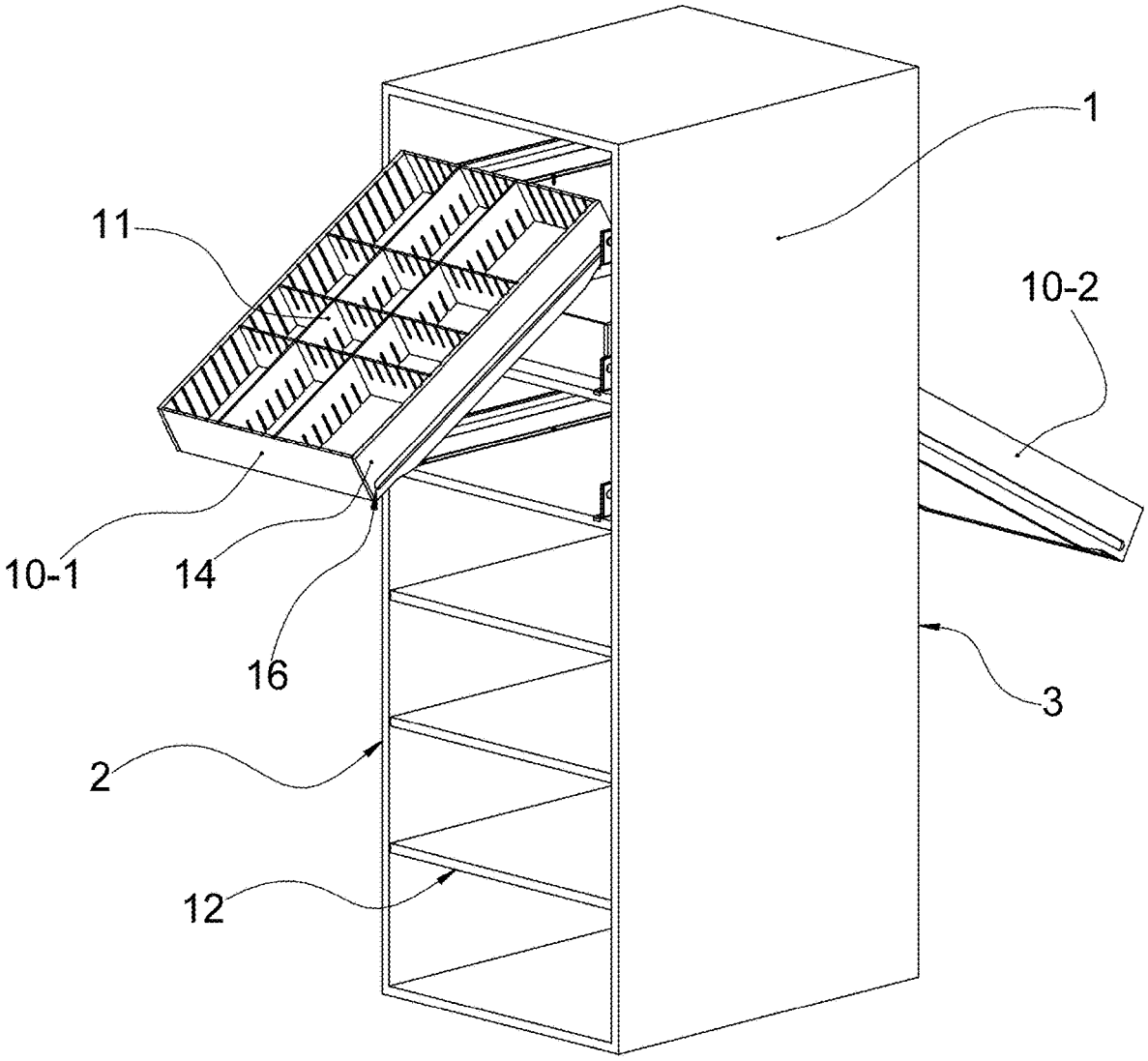
FIG. 3 again illustrates the cabinet of FIG. 1, where this view shows the inventive drawers as fully extended and tilting downward, one drawer shown as fully extended and tilted downward from the front face and another drawer shown as fully extended and tilted downward from the rear face of the cabinet.

As mentioned above, one embodiment of the present invention allows for two-way movement of drawers 10 within cabinet 1 (e.g., for a "nurse sever" cabinet configuration). This two-way access to drawers 10 is illustrated in FIG. 3, which shows a first drawer 10-1 being extended from a first face 2 of cabinet 1 and a second drawer 10-2 being extended from a second, opposing face 3 of cabinet 1. In the view of FIG. 3, each drawer has been fully extended (i.e., 100% extension) so as to introduce the tilting feature of the inventive drawer. As shown, by virtue of introducing the tilt, a user has an easier time gaining access to materials stored within the "back" of the drawer. Also shown in the view of FIG. 3 is a collection of drawer dividers 11 that may be used in conjunction with an exemplary tiltable drawer 10-1 in order to define individual partitions within a drawer for better organization of the materials stored therein. Indeed, the use of drawer dividers 11 prevents those items located in the back area of drawer 10-1 from falling forward once the drawer is tilted downward in the manner shown in FIG. 3. While the remaining drawings do not explicitly show such dividers, it is to be understood that they may be used with any embodiment of the present invention.

Figure 4:
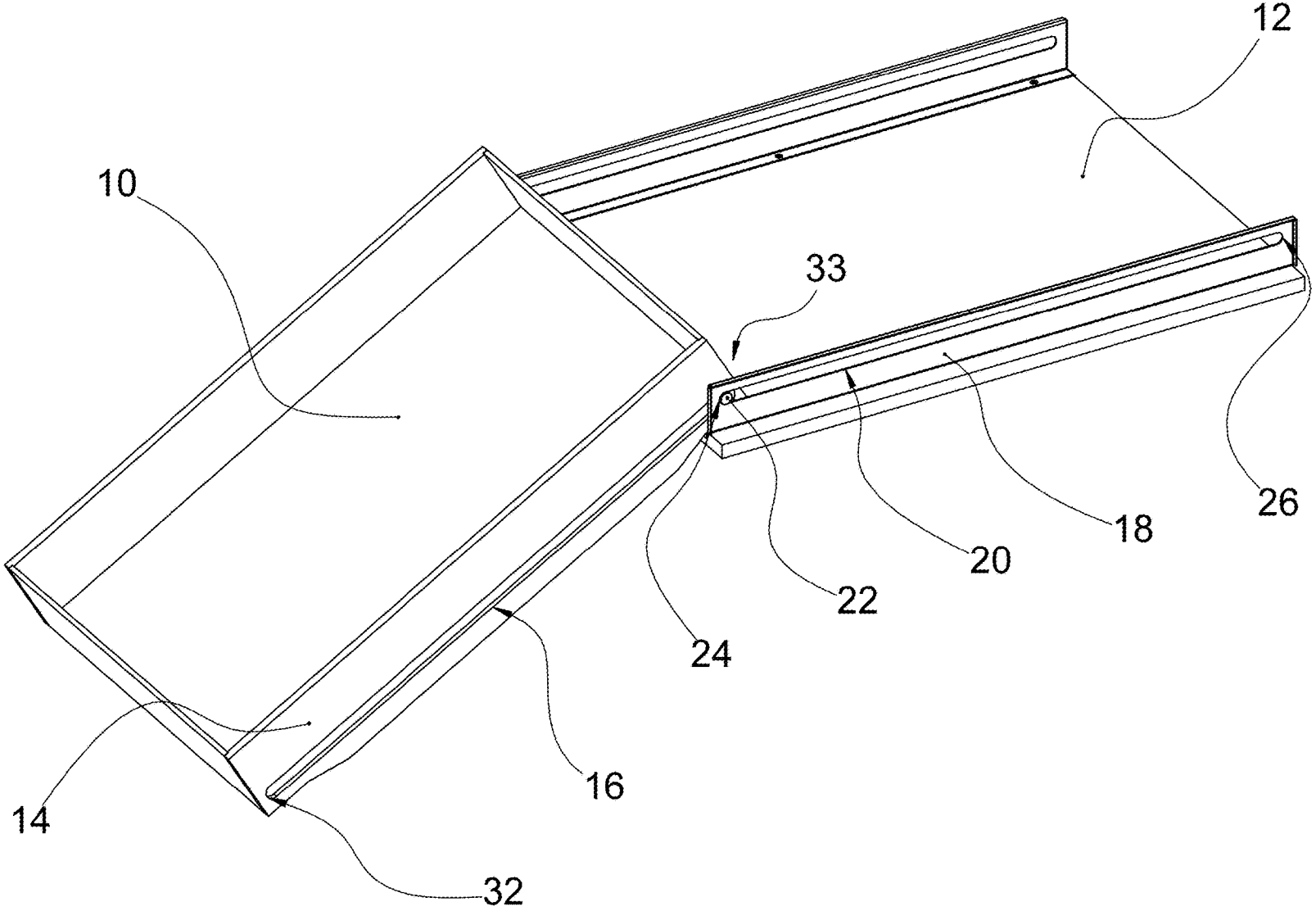
FIG. 4 is an isometric view of an exemplary embodiment of the present invention, showing the configuration of an inventive tiltable shelf as used in combination with a supporting shelf.

FIG. 4 is a detailed view of an exemplary tiltable drawer 10 and associated shelf 12 formed in accordance with an exemplary embodiment of the present invention. As mentioned above, tiltable drawer 10 is formed to including a pair of longitudinal channels 16 that extend along the outer surface of sides 14. It is to be understood that longitudinal channels 16 do not extend completely to either corner edge, but terminate at defined channel stops 32, 33 in proximity to each opposing corner. Channel stop 32 is visible in the view of FIG. 4, with channel stop 33 best shown in the views of FIGS. 6 and 7. Channel stops 32, 33 thus prevent tiltable drawer 10 from become detached from the associated cabinet when drawer 10 is fully extended outward and downward.

Referring back to FIG. 4, shelf 12 is shown as including a pair of side plates 18, with each side plate formed to include a longitudinal slot 20. A roller 22 is shown as disposed between side 12 (of drawer 10) and plate 18 (of shelf 12) such that roller 22 engages with and rides between longitudinal channel 16 and longitudinal slot 20. It is to be understood that the configuration of the present invention includes a pair of such rollers 22, one engaging each opposing side 14 of drawer 10. As shown, longitudinal slots 20 are formed to terminate at predetermined "stop" locations 24, 26 at opposing ends of side plate 18. As drawer 10 is moved with respect to shelf 12, roller 22 moves within the combination of longitudinal channel 16 and longitudinal slot 20, until stop location 24 (for example) is reached. This location is associated with the 100% extension of drawer 10, and allows drawer 10 to tilt downward without becoming displaced from the cabinet.

Figure 5:
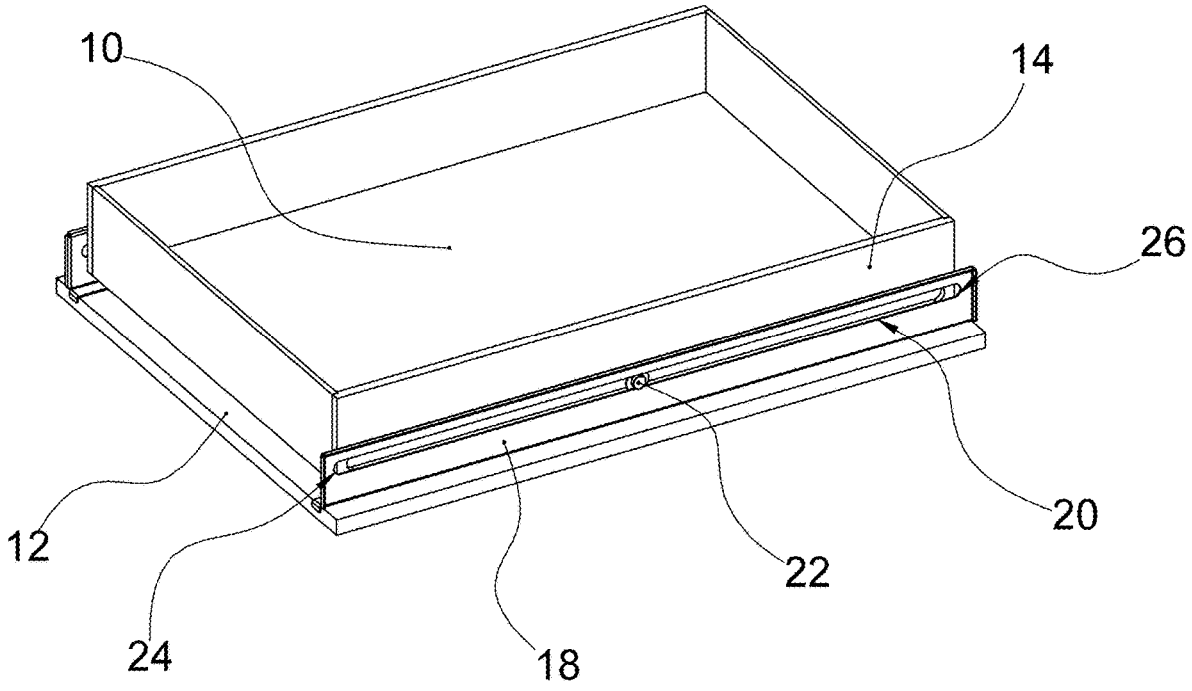
FIG. 5 illustrates the same embodiment as shown in FIG. 4, in this case depicting the tiltable shelf as positioned in place (i.e., in its fully closed position) on the supporting shelf.
Figure 6:
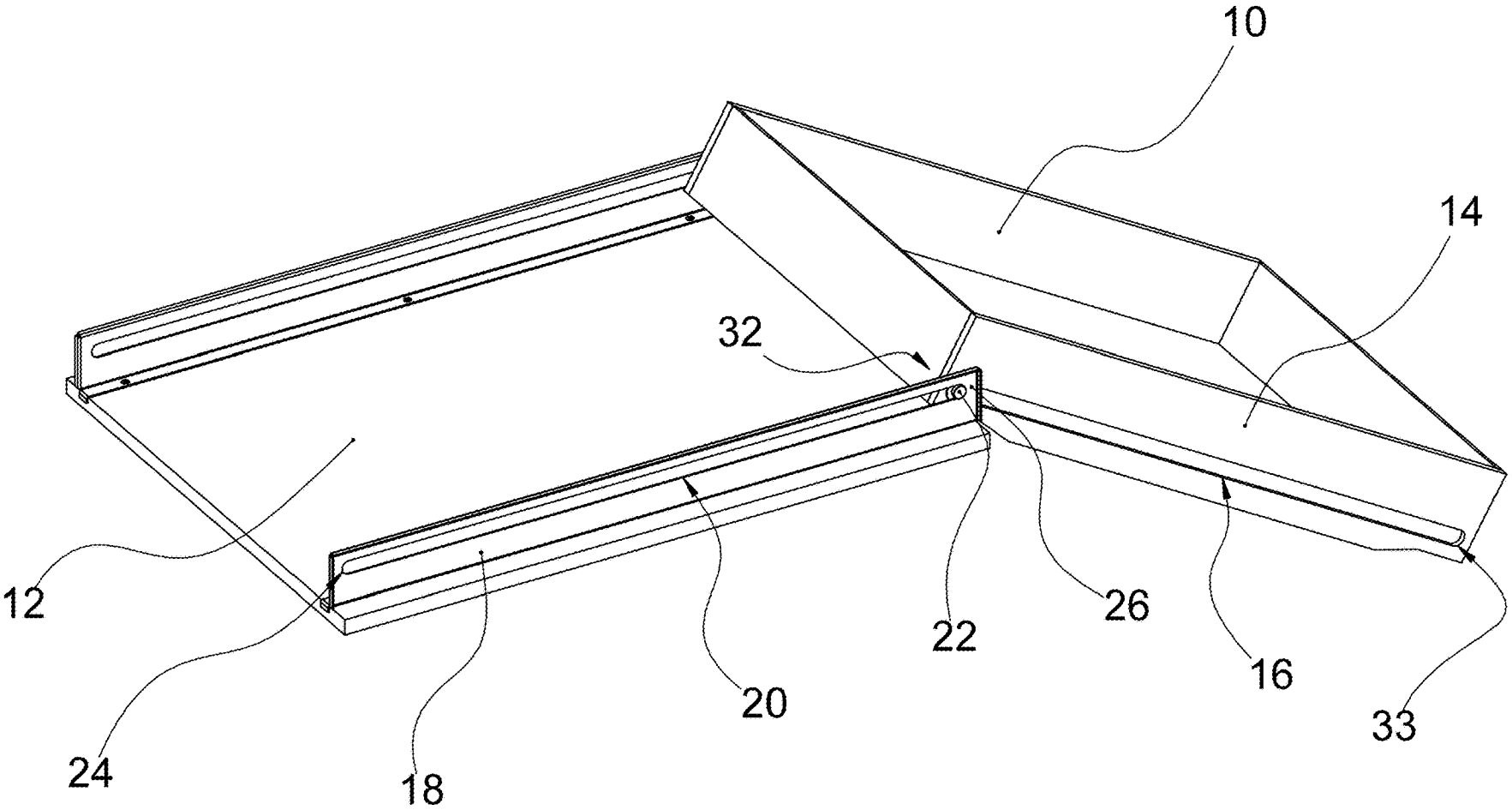
FIG. 6 is another isometric view of the arrangement of FIG. 4, in this case illustrating the movement of the tiltable drawer in the opposite direction, this feature of the present invention useful in cabinets such as nurse servers where individuals need to access the drawers from either side of the cabinet.

FIG. 5 shows drawer 10 as fully closed and in place on shelf 12. When fully closed, roller 22 will be positioned at the midpoint of the length of plate 18, as shown. For the sake of completeness, FIG. 6 shows drawer 10 as extending outward in the opposing direction of the view of FIG. 4, as configured in the preferable two-way tilt embodiment of the present invention. Opposing channel stop 33 is particularly evident in this view.

Figure 7:
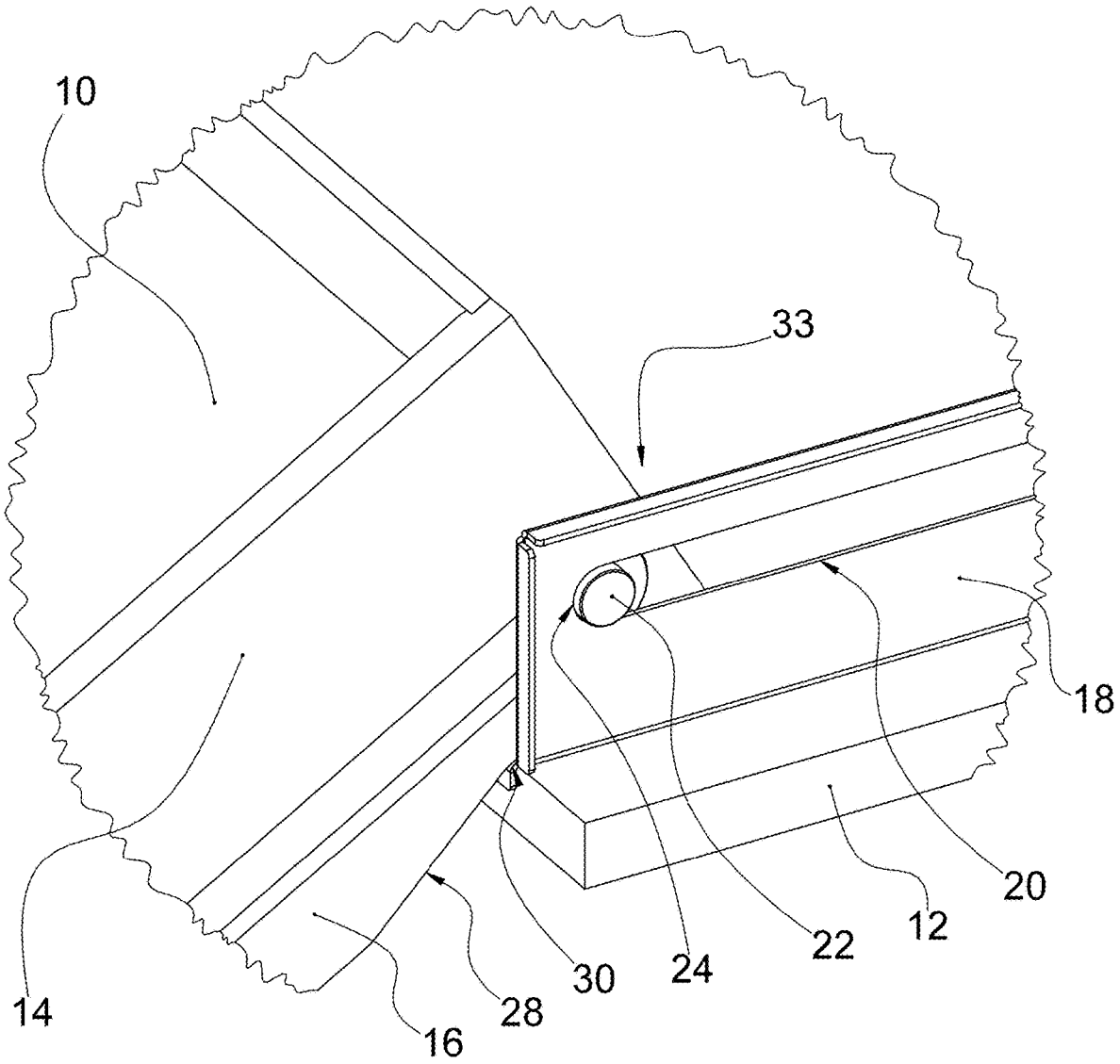
FIG. 7 is a close-up isometric view of a portion of the connection between a tiltable drawer and associated shelf, showing the use of a roller engaged between a channel and slot to control the movement of the tiltable drawer with respect to the shelf.

FIG. 7 is a detailed view of an exemplary tilting arrangement between drawer 10 and shelf 12. Evident in this view is roller 22 as positioned between longitudinal channel 16 and longitudinal slot 20, where in particular roller 22 has moved along as drawer 10 has been fully extended from shelf 12, with roller 22 coming into contact with termination 24 of longitudinal slot 20, as well as termination 33 of longitudinal channel 16. The contact between roller 22 and terminations 24, 33 thus prevents drawer 10 from becoming dis-engaged with the associated cabinet.

As particularly shown in FIG. 7, the circular geometry of roller 22 enables drawer 10 to rotate downward (i.e., "tilt") once it is completely extended. In this particular embodiment, a lower edge 28 of side 14 of drawer 10 is ramped, which helps to control the degree of tilt, as well as the movement of drawer 10. Shelf 12 is shown in this embodiment as including a support feature 30 that is disposed along its front edge. Support feature 30 provides additional mechanical support for the tilted drawer, which may be required for applications where heavy items are to be stored.

Figure 8:
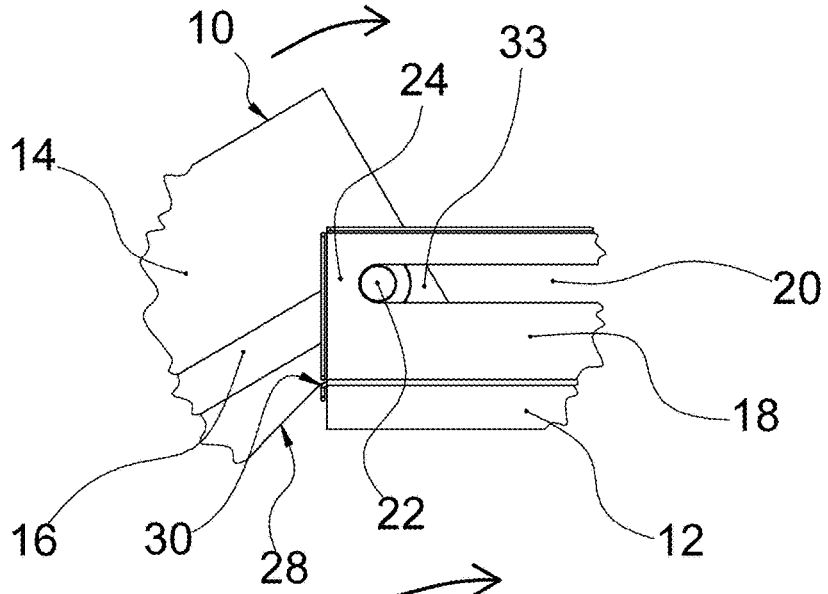
FIG. 8 illustrates the same view as shown in FIG. 7, in this case indicating the direction of movement for rotating the tiltable drawer back in place on the shelf.
Figure 9:
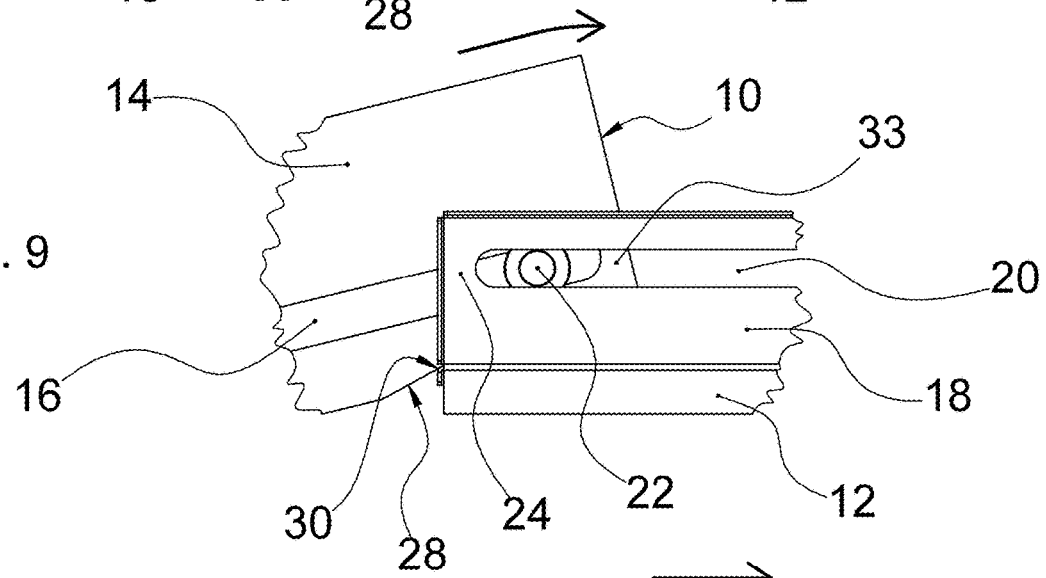
FIG. 9 shows further movement of the drawer of FIG. 7, as indicated by the movement of the roller along the channel/slot combination and the further rotation of the drawer toward the horizontal position.
Figure 10:
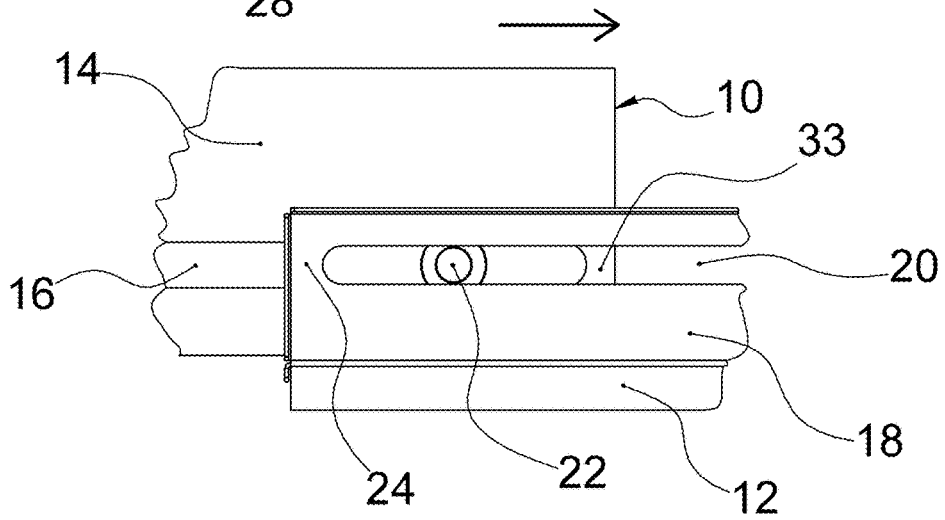
FIG. 10 shows yet further movement of the drawer of FIG. 7, in this case showing the tiltable drawer as fully re-positioned on the associated shelf (towards the closed position)

FIGS. 8-10 illustrate, in a series of drawings, the movement of drawer 10 from a "fully extended" position (FIG. 8) to being located back on shelf 12 (FIG. 10). Only the portions of drawer 10 associated with controlling the mechanical movement are shown in FIGS. 8-10, for the sake of simplicity.

Referring to the fully-extended configuration of FIG. 8, the return movement of drawer 10 back onto shelf 12 is shown in this embodiment as being facilitated by lower ramp edge 28, which is tapered as mentioned above to guide drawer 10 smoothly back into place by guiding the tilted drawer back into a horizontal orientation. Side plate 18, longitudinal slot 20, and roller 22 are also shown.

FIG. 9 shows the initial movement of drawer 10, as indicated by the arrow, with roller 22 shown as traveling along between the combination of longitudinal channel 16 and longitudinal slot 20. In particular, roller 22 has moved leftward with respect to end termination 24 of shelf plate 18, and the inclusion of ramp edge 28 has brought drawer 10 closer to a horizontal position. FIG. 10 shows the continued movement of drawer 10, where at this point drawer 10 has essentially returned to its horizontal orientation, ramp edge 28 no longer visible as being positioned behind plate 18. When drawer 10 is fully inserted and positioned over shelf 12, roller 22 will be located at the midpoint of longitudinal slot 20 (as shown in FIG. 5, described above).

Figure 11:
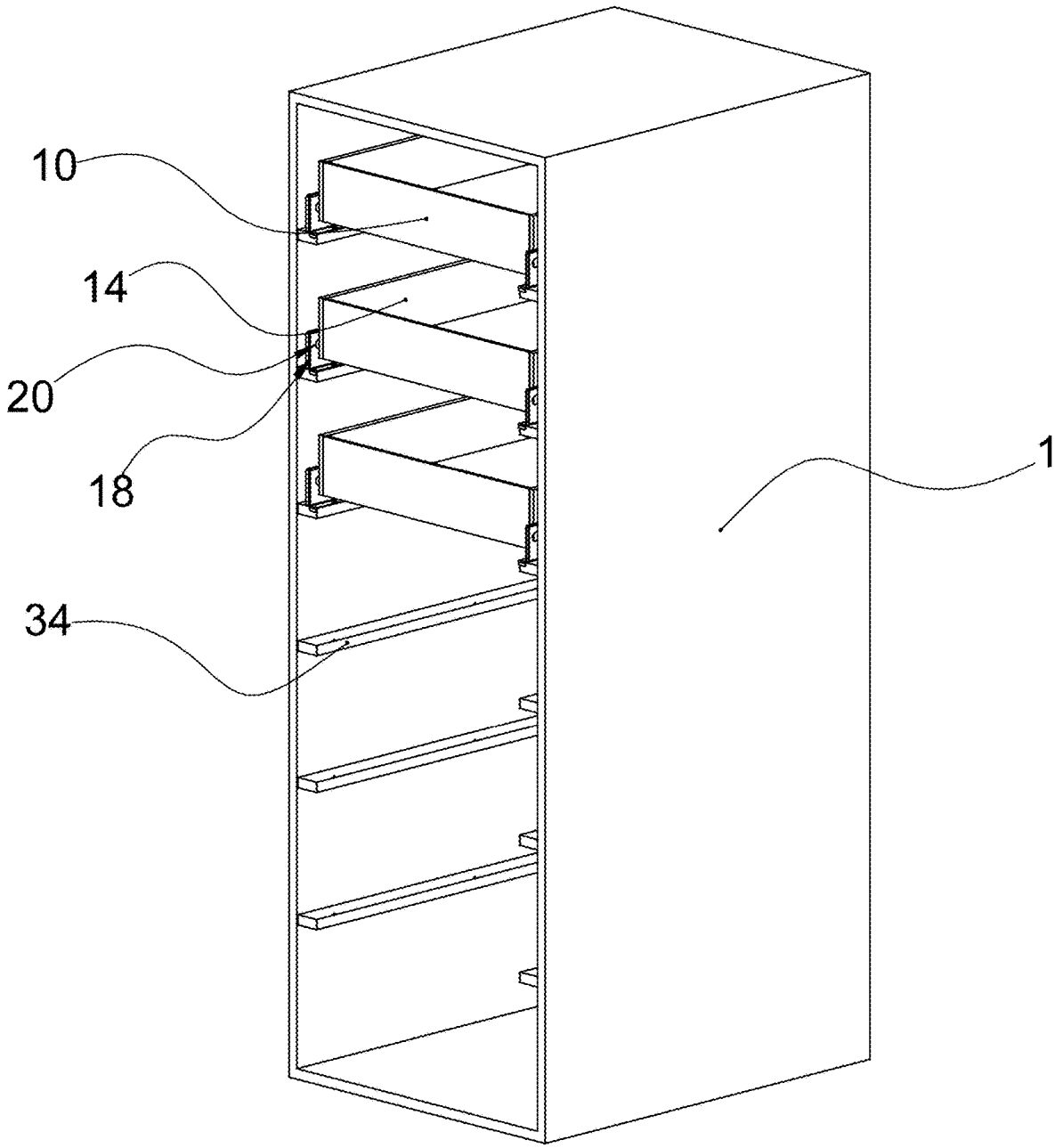
FIG. 11 is an isometric view of an alternative embodiment of the present invention, wherein this case a tiltable drawer is used in combination with a pair of support rails (instead of a shelf), with the support rails formed to include slots that allow for engagement with the channels of the tiltable drawer via rollers, as in the above-described embodiment.

FIG. 11 illustrates an alternative embodiment of the present invention, where instead of utilizing a full-sized shelf 12 as a support structure, tiltable drawer 10 is positioned on a pair of support rails 34. The lower portion of cabinet 1 shows support rails 34 without tiltable drawer 10 so as to provide a clear view of the positioning of these elements. It is to be understood that the width of support rails 34 is a design consideration, where various widths may be utilized depending on the material being stored on tiltable drawers 10. Similar to the embodiment described above, a side plate 18 (including longitudinal slot 20) and roller 22 is attached to each support rail 34 and coupled to drawer 10 in the manner described above.

Figure 12:
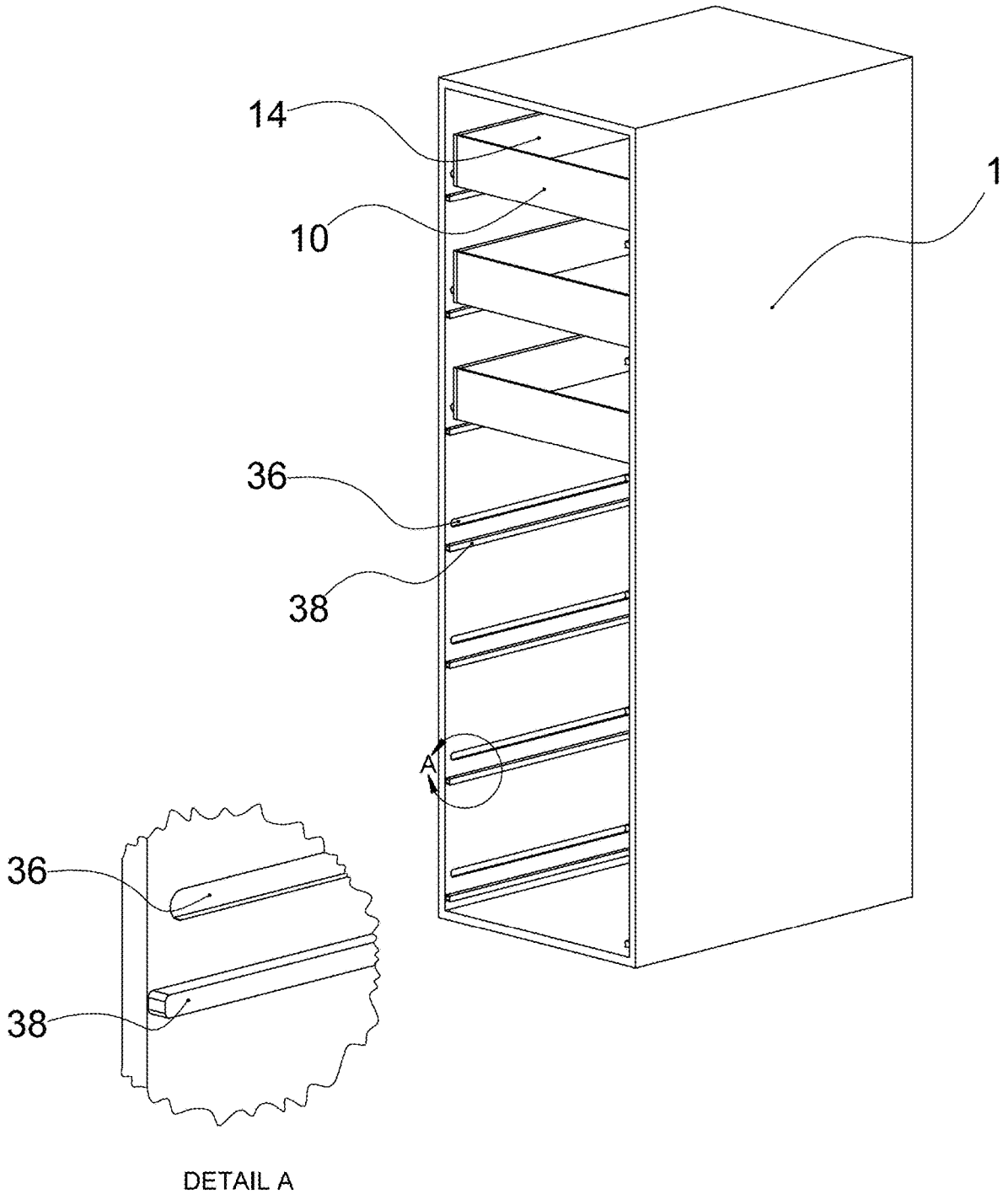
FIG. 12 is an isometric view of yet another embodiment of the present invention, where in this case the interior walls of a cabinet are configured to include slots and support rails for supporting a tiltable drawer in accordance with the present invention.

It is contemplated that one or more of the embodiments of the present invention may be "retrofit" into an existing cabinet that has pre-installed shelves or rails. Additionally, it is contemplated that a "new construction" cabinet may be initially formed to include the necessary components of the present invention. FIG. 12 illustrates an exemplary cabinet 1A that is initially constructed to incorporate tiltable drawers 10 of the present invention. As shown, cabinet 1A is formed to include a plurality of longitudinal channels 36 that function in the same manner as longitudinal slots 20 in the above-described embodiments. Built-in support rails 38 are utilized to support drawers 10 in the same manner as with the embodiment described above in association with FIG. 11. In this embodiment, rollers 22 are disposed between longitudinal channels 16 of drawer 10 and longitudinal channels 36 of cabinet 1A, allowing for full extension (and tilt) of each drawer 10. Moreover, it is to be understood that the mechanism of the present invention for providing tiltable drawers may be incorporated within a wall system without the need for providing a separate "cabinet" configuration.

Without further description it is thought that the features and advantages of the invention will be readily apparent to those skilled in the art, and it will of course be understood that changes in the form, proportion and minor details of construction may be resorted to without departing from the scope thereof. Indeed, many modifications and variations of the invention are possible in light of the above teachings. It is therefore to be understood that the full scope of the invention is not limited to the details disclosed herein and may be practiced otherwise than as specifically described.

What is claimed is:

1. A tiltable drawer comprising a front panel, a rear panel, and a bottom surface disposed between and orthogonal to the front and rear panels;

a pair of opposing sidewalls extending from the front panel to the rear panel along open sides of the bottom surface, each sidewall including a longitudinal channel formed to extend along an outer surface thereof, and each longitudinal channel terminating at opposing stops in proximity of an edge location of each sidewall with a mating front and rear panel;

a support structure disposed adjacent to the pair opposing sidewalls, the support structure including a pair of side plates, each side plate associated with a separate one of the pair of opposing sidewalls and including a longitudinal slot formed therethrough, each longitudinal slot terminating at opposing stops in proximity to an edge of an associated side plate; and a pair of circular rollers, each circular roller disposed to engage with and ride between a sidewall longitudinal channel and with its associated side plate slot, wherein upon movement of the tiltable drawer the pair of circular rollers allows for the pair of opposing sidewalls to fully extend and rotate downward, following the circular surface of the pair of circular rollers and exposing the rear panel, wherein the engagement of a pair of sidewall longitudinal channel stops with a pair of support structure longitudinal slots, provided by the pair of circular rollers, prevents the pair of opposing sidewalls from disengaging with the support structure upon full extension.

2. The tiltable drawer as defined in claim 1 wherein the pair of opposing sidewalls is formed to including ramp edge along a bottom portion thereof, promoting rotational movement of the pair of opposing sidewalls downward upon full extension.

3. The tiltable drawer as defined in claim 1 wherein the support structure further comprises a front support element disposed to be positioned underneath the rear panel when the drawer is fully extended.

4. The tiltable drawer as defined in claim 1 wherein the support structure comprises a support shelf surface, with the pair of opposing side plates attached thereto.

5. The tiltable drawer as defined in claim 1 wherein the support structure comprises a pair of support rails affixed to an exterior structure, with the pair of opposing side plates attached thereto.

6. A cabinet including a frame enclosure including at least a first, open end at least one tiltable drawer disposed within the frame enclosure, the at least one tiltable drawer comprising a front panel, a rear panel, and a bottom surface disposed between and orthogonal to the first and rear panels;

a pair of opposing sidewalls extending from the front panel to the rear panel along open sides of the bottom surface, each sidewall including a longitudinal channel formed to extend along an outer surface thereof, and each longitudinal channel terminating at opposing stops in proximity of an edge location of each sidewall with a mating front and rear panel;

a support structure attached to an interior area of the cabinet frame enclosure and disposed adjacent to the pair opposing sidewalls of the tiltable drawer, the support structure including a pair of side plates, each side plate associated with a separate one of the pair of opposing sidewalls and including a longitudinal slot formed therethrough, each longitudinal slot terminating at opposing stops in proximity to an edge of an associated side plate; and a pair of circular rollers, each circular roller disposed to engage with and freely move between a sidewall longitudinal channel and its associated side plate slot, wherein upon movement of the tiltable drawer the pair of circular rollers allows for the pair of opposing sidewalls to fully extend outward from the first, open end of the frame enclosure and rotate downward, following the circular surface of the pair of circular rollers, wherein the inclusion of the opposing stops prevents the pair of opposing sidewalls from disengaging with the support structure upon full extension.

7. The cabinet as defined in claim 6 wherein the frame enclosure further comprises a second, open end disposed in opposition to the first, open end, and at least one tiltable drawer is configured to extend outward from the cabinet frame enclosure by movement out of either one of the first, open end and the opposing second, open end, providing two-way movement of the tiltable drawer with respect to the cabinet frame enclosure.

8. The cabinet as defined in claim 6 wherein the support structure is integrally formed as part of an interior surface of the cabinet frame enclosure without separate side plates.

* * * * *